US008120553B2

(12) United States Patent
Kim

(10) Patent No.: US 8,120,553 B2
(45) Date of Patent: Feb. 21, 2012

(54) ORGANIC LIGHT EMITTING DIODE DISPLAY DEVICE

(75) Inventor: Changyeon Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 752 days.

(21) Appl. No.: 12/003,716

(22) Filed: Dec. 31, 2007

(65) Prior Publication Data

US 2008/0180364 A1 Jul. 31, 2008

(30) Foreign Application Priority Data

Jan. 26, 2007 (KR) ..... 10-2007-0008400

(51) Int. Cl.
*G09G 3/30* (2006.01)

(52) U.S. Cl. ..... 345/76; 315/169.3

(58) Field of Classification Search ..... 345/76–81; 315/169.3

See application file for complete search history.

(56) References Cited

U.S. PATENT DOCUMENTS 7,616,178 B2 * 11/2009 You et al. ..... 345/79
2004/0201581 A1 * 10/2004 Miyazawa ..... 345/204
2004/0256617 A1 * 12/2004 Yamada et al. ..... 257/59
2004/0257353 A1 * 12/2004 Imamura et al. ..... 345/204
2005/0052377 A1 * 3/2005 Hsueh ..... 345/82
2006/0145968 A1 * 7/2006 You et al. ..... 345/76
2006/0221004 A1 * 10/2006 You et al. ..... 345/76
2007/0164938 A1 * 7/2007 Shin et al. ..... 345/76
2008/0136750 A1 * 6/2008 Benzarti ..... 345/76

FOREIGN PATENT DOCUMENTS

WO WO 2006087477 A1 * 8/2006

* cited by examiner

*Primary Examiner* — Amare Mengistu
*Assistant Examiner* — Dmitriy Bolotin
(74) *Attorney, Agent, or Firm* — Morgan, Lewis & Bockius LLP

(57) ABSTRACT

An organic light emitting diode display device and a driving method thereof are disclosed. The organic light emitting diode display device comprises: a display panel having an m-number of first data lines and an n-number of gate lines crossing each other, an m-number of second data lines and the n-number of gate lines crossing each other, pixels formed at common crossing regions, and an n-number of reset lines arranged corresponding to the n-number of gate lines one by one and connected to the adjacent pixels; a data driving circuit for converting input digital data into a real data voltage and an inverse data voltage and selectively supplying the real data voltage and the inverted data voltage to the first and second data lines; a gate driver for sequentially supplying scan pulses to the gate lines; and a reset pulse supply unit for sequentially supplying reset pulses to the reset lines.

19 Claims, 7 Drawing Sheets

ORGANIC LIGHT EMITTING DIODE DISPLAY DEVICE

CROSS-REFERENCE TO RELATED APPLICATION

The present application claims priority under 35 U.S.C. §119 to Korean Patent Application No. 10-2007-0008400 filed on Jan. 26, 2007, which is hereby incorporated by reference in its entirety.

BACKGROUND

1. Field

This document relates to a display device, and more particularly, to an organic light emitting diode display device and a driving method thereof.

2. Related Art

Recently, various flat display panel technologies have become more common due to reduced weight and bulk in comparison to cathode ray tube (CRT) technology. Such flat display panel technologies include liquid crystal displays, field emission displays, plasma display panels, and electroluminescence (EL) display devices.

Among these, the EL display device is a self-luminous device that causes a fluorescent substance to emit light by a re-combination of an electron and a hole, and can be generally classified into an inorganic EL where an inorganic compound is used as the fluorescent substance and an organic EL where an organic compound is used. The EL display device has many advantages such as low driving voltage self-luminescence, thin profile, wide-viewing angle, rapid response speed, and high contrast. Hence, the EL device is expected to be a next generation display device.

The organic EL device generally includes an electron injection layer, an electron transport layer, a light-emitting layer, a hole transport layer, and a hole injection layer. In such an organic EL device, when a specified voltage is applied between an anode and a cathode, an electron generated from the cathode moves to the light-emitting layer through the electron injection layer and the electron transport layer. Meanwhile, a hole generated from the anode moves to the light-emitting layer through the hole injection layer and the hole transport layer. Accordingly, the re-combination of the electron and the hole supplied from the electron transport layer and the hole transport layer causes light to be emitted in the light-emitting layer.

The circuit configuration of each pixel of a general organic light emitting diode display device using such an organic EL will be discussed with reference to FIG. 1.

FIG. 1 is an equivalent circuit diagram of a pixel of a general organic light emitting diode display device.

Referring to FIG. 1, each pixel of the organic light emitting diode display device comprises a switching thin film transistor S_TR1 turned on by a scan pulse supplied through a gate line GL and for switching a data voltage supplied through a data line DL, a storage capacitor Cst for charging the data voltage supplied through the switching thin film transistor S_TR1, an organic light emitting diode OLED turned on by a driving current supplied from a power supply terminal to which a high potential power voltage VDD, and a driving thin film transistor D_TR1 turned on by the data voltage supplied through the switching thin film transistor S_TR1 or the charge voltage of the storage capacitor Cst and for driving the organic light emitting diode OLED.

The switching thin film transistor S_TR1 is an N-MOS thin film transistor having a gate connected to the gate line GL, a drain connected to the data line DL, and a source commonly connected to the storage capacitor Cst and the gate of the driving thin film transistor D_TR1. The switching thin film transistor S_TR1 is turned on by the scan pulse supplied through the gate line GL to supply the data voltage supplied through the data line DL to the storage capacitor Cst and the driving thin film transistor D_TR1.

The storage capacitor Cst has one side commonly connected to the switching thin film transistor S_TR1 and the gate of the driving thin film transistor D_TR1 and other side connected to a ground, and is charged with the data voltage supplied through the switching thin film transistor S_TR1. The storage capacitor Cst discharges the charged voltage when the data voltage being supplied through the switching thin film transistor S_TR1 is stopped to be applied to the gate of the driving thin film transistor D_TR1, that is, when the gate voltage of the driving thin film transistor D_TR1 starts to be dropped, thereby holding the gate voltage of the driving thin film transistor D_TR1. Accordingly, even if the supply of the data voltage supplied through the switching thin film transistor S_TR1 is stopped, the driving thin film transistor D_TR1 keeps a turned-on state by the charge voltage of the storage capacitor Cst during the holding period by the storage capacitor Cst.

The organic light emitting diode OLED has an anode connected to the power supply terminal applied with the high potential power voltage VDD and a cathode connected to the drain of the driving thin film transistor D_TR1.

The driving thin film transistor D_TR1 is an N-MOS thin film transistor having a gate commonly connected to the source of the switching thin film transistor S_TR1 and the switching transistor S_TR1, a drain connected to the cathode of the organic light emitting diode OLED, and a source connected to the ground. The driving thin film transistor D_TR1 is turned on by the data voltage supplied to the gate via the switching thin film transistor S_TR1 and the charge voltage of the switching thin film transistor S_TR1 supplied to the gate and switches a driving current flowing in the organic light emitting diode OLED over to the ground, thereby allowing the organic light emitting diode OLED to emit light by the driving current generated by the high potential power voltage VDD.

Since the conventional organic light emitting diode display device with pixels having an equivalent circuit employs one driving thin film transistor, there is a problem that the driving thin film transistor is deteriorated due to a stress by a bias continuously applied to the gate of the driving thin film transistor.

In order to solve this problem, there has been developed a conventional organic light emitting diode display device which has two driving thin film transistors formed in each pixel, and the two driving thin film transistors provided in each pixel are alternately driven so as to reduce the stress caused by the bias. The conventional organic light emitting diode display device of this type supplies a high potential power voltage VDD, the driving voltage of an organic light emitting diode, to the organic light emitting diode of each pixel through one power supply line formed on a display panel (not shown), and thus the high potential power voltage VDD is dropped due to the resistance component of the power supply line and supplied to each pixel. By the dropping of the high potential power voltage VDD, the conventional organic light emitting diode display device with two thin film transistors formed in each pixel is unable to represent a desired gray level for each pixel.

SUMMARY

An aspect of this document is to provide an organic light emitting diode display device, which can compensate for the drop of a high potential power voltage, the driving voltage of an organic light emitting diode provided in each pixel, by the resistance component on a power supply line, and a driving method thereof.

Another aspect of this document is to provide an organic light emitting diode display device, which can represent a desired gray level for each pixel by compensating for a high potential power voltage, the driving voltage of an organic light emitting diode, dropped by the resistance component on a power supply line, and a driving method thereof.

An organic light emitting diode display device in accordance with one embodiment of the present invention comprises: a display panel having an m-number of first data lines and an n-number of gate lines crossing each other, an m-number of second data lines and the n-number of gate lines crossing each other, pixels formed at common crossing regions, and an n-number of reset lines arranged corresponding to the n-number of gate lines one by one and connected to the adjacent pixels; a data driving circuit for converting input digital data into a real data voltage and an inverse data voltage and selectively supplying the real data voltage and the inverted data voltage to the first and second data lines; a gate driver for sequentially supplying scan pulses to the gate lines; and a reset pulse supply unit for sequentially supplying reset pulses to the reset lines.

A driving method of an organic light emitting diode display device in accordance with one embodiment of the present invention comprises: converting input digital data into a real data voltage and an inverse data voltage; supplying a high potential power voltage in response to a supplied reset pulse and resetting first and second driving thin film transistors of each pixel; selectively supplying the real data voltage and the inverse data voltage in response to a supplied scan pulse and turning on the reset first driving thin film transistor or the reset second driving thin film transistor; and alternatively turning on the first driving thin film transistor or the second driving thin film transistor and supplying the high potential power voltage to the organic light emitting diode of each pixel.

An organic light emitting diode display device in accordance with another embodiment of the present invention comprises: a display panel having an m-number of data lines and an n-number of first gate lines crossing each other, the m-number of data lines and an n-number of second gate lines crossing each other, pixels formed at common crossing regions, and an n-number of reset lines arranged corresponding to the n-number of first and second gate lines one by one and connected to the adjacent pixels; a data driver for converting digital data inputted in 1 horizontal unit into a real data voltage and an inverse data voltage and selectively supplying the real data voltage and the inverse data voltage to the first and second data lines for 1 horizontal period; a gate driving circuit for sequentially supplying a first scan pulse to the first gate lines and a second scan pulse to the second gate lines; and a reset pulse supply unit for sequentially supplying reset pulses to the reset lines, wherein the gate driver sequentially supplies the first and second scan pulses to the first and second gate lines included in the same horizontal line.

A driving method of an organic light emitting diode display device in accordance with another embodiment of the present invention comprises: converting digital data inputted in a 1 horizontal unit into a real data voltage and an inverse data voltage and selectively supplying the real data voltage and the inverse data voltage to the first and second data lines for a 1 horizontal period; supplying a high potential power voltage in response to a supplied reset pulse and resetting the first and second driving thin film transistors of each pixel; sequentially supplying first and second scan pulses to first and second gate lines included in one horizontal line; supplying the real data voltage or inverse data voltage on the data lines in response to the first scan pulse supplied through the first gate lines and turning on or turning off the reset first driving thin film transistor; supplying the real data voltage or inverse data voltage on the data lines in response to the second scan pulse supplied through the second gate lines and turning on or turning off the reset second driving thin film transistor; and alternatively turning on the first driving thin film transistor or the second driving thin film transistor and supplying the high potential power voltage to the organic light emitting diode of each pixel.

The present invention can compensate for a high potential power voltage, the driving voltage of an organic light emitting diode, dropped by the resistance component on a power supply line and thus, represent a desired gray level for each pixel by resetting the gates of the two driving thin film transistors provided in each pixel before the two driving thin film transistors are turned on.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

DETAILED DESCRIPTION

Reference will now be made in detail embodiments of the invention examples of which are illustrated in the accompanying drawings.

Hereinafter, an implementation of this document will be described in detail with reference to the attached drawings.

Figure 1:
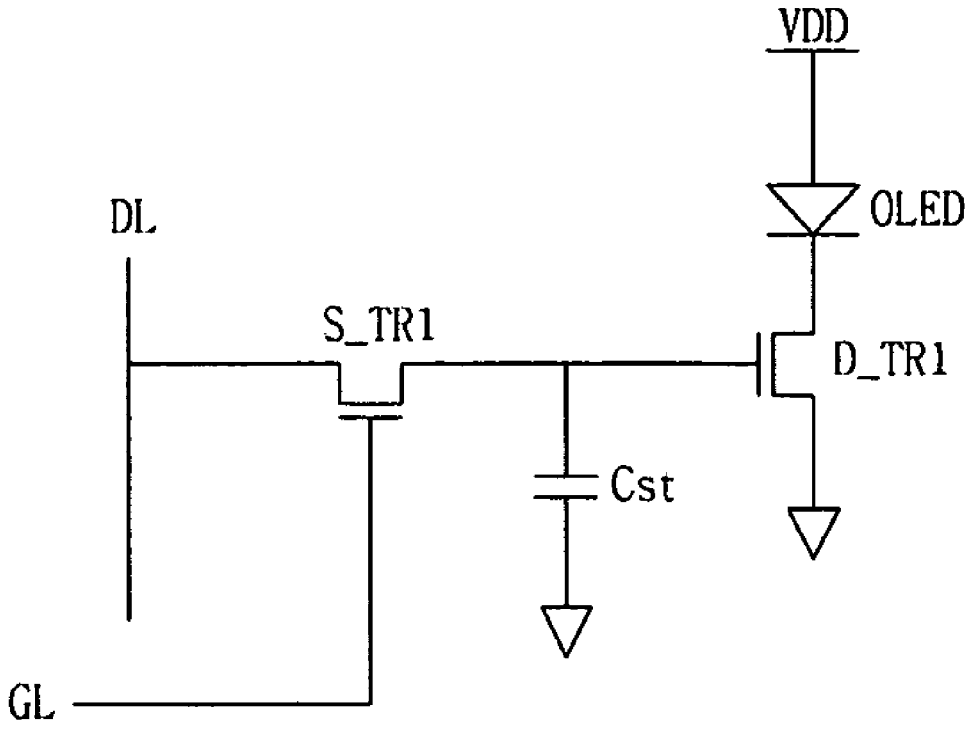
Fig. 1 RELATED ART
FIG. 1 is an equivalent circuit diagram of each pixel of a general organic light emitting diode display device.
Figure 2:
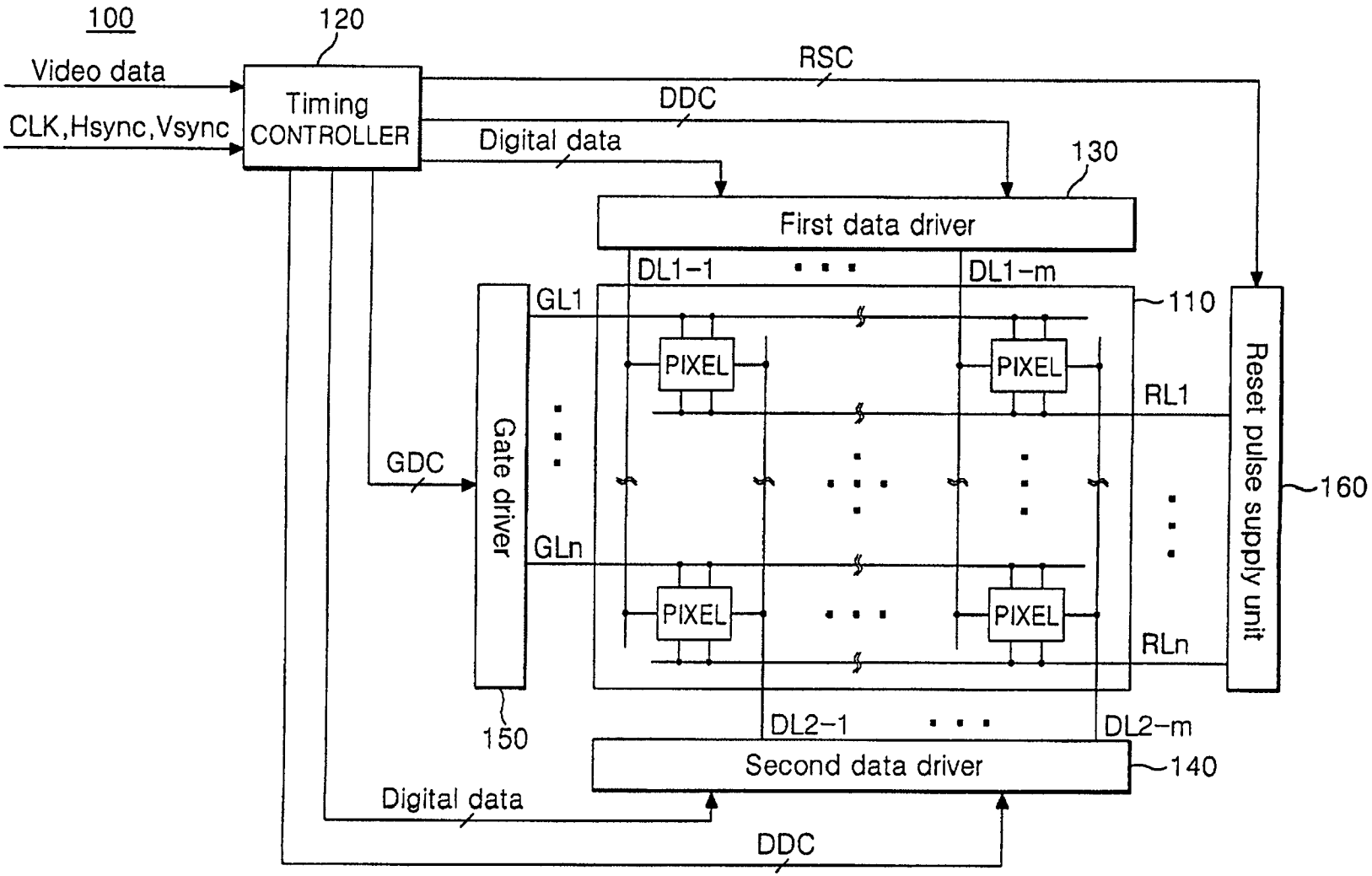
FIG. 2 is a block diagram of an organic light emitting diode display device in accordance with one embodiment of the present invention.

FIG. 2 is a block diagram of an organic light emitting diode display device in accordance with one embodiment of the present invention.

Referring to FIG. 2, the organic light emitting diode display device 100 in accordance with one embodiment of the present invention comprises a display panel 110 having an m-number of first data lines DL1-1 to DL1-*m* and an n-number of gate lines GL1 to GLn crossing each other, an m-number of second data lines DL2-1 to DL2-*m* and the n-number of gate lines GL1 to GLn crossing each other, pixels formed at common crossing regions, and an n-number of reset lines RL1 to RLn arranged corresponding to the n-number of gate lines GL1 to GLn one by one and connected to the adjacent pixels, and a timing controller 120 for controlling data display on the display panel 110.

Additionally, the organic light emitting diode display device 100 comprises a first data driver 130 for converting digital data supplied from the timing controller 120 into an analog data voltage under control of the timing controller 120 to supply the same to the m-number of first data lines DL1-1 to DL1-*m* and inverting the polarity of the analog data voltage in 1 frame unit to supply the same the same, a second data driver 140 for converting the digital data supplied from the timing controller 120 into an analog data voltage under control of the timing controller 120 to supply the same to the m-number of second data lines DL2-1 to DL2-*m* and inverting the polarity of the analog data voltage in 1 frame unit to supply the same, a gate driver 150 for sequentially supplying scan pulses to the n-number of gate lines GL1 to GLn under control of the timing controller 120, and a reset pulse supply unit 160 for sequentially supplying reset pulses to the n-number of reset lines RL1 to RLn.

On the display panel 110, the m-number of first data lines DL1-1 to DL1-*m*, the n-number of gate lines GL1 to GLn, the m-number of second data lines DL2-1 to DL2-*m*, and the n-number or reset lines RL1 to RLn are arranged.

Herein, the m-number of first data lines DL1-1 to DL1-*m* and the m-number of second data lines DL2-1 to DL2-*m* cross the n-number of gate lines GL1 to GLn to form common crossing regions, and pixels each having two driving thin film transistors are formed in the crossing regions. The n-number or reset lines RL1 to RLn are arranged corresponding to the n-number of gate lines GL1 to GLn one by one and connected to the adjacent pixels.

The timing controller 120 supplies digital video data (RGB data or RGBW data or the like) inputted from the system to the first and second data drivers 130 and 140. Also, the timing controller 120 generates a data driving control signal DDC and a gate driving control signal GDC using a horizontal/vertical synchronizing signal H and V, and a reset control signal RSC.

The timing controller 120 supplies the generated driving control signal DDC to the first and second data drivers 130 and 140. Also, the timing controller 120 supplies the generated gate driving control signal GDC and reset control signal RSC to the gate driver 140 and the reset pulse supply unit 160, respectively.

Herein, the data driving control signal DDC comprises a source start pulse SSP, a source shift clock signal SSC, and a polarity control signal PCS, and the gate driving control signal GDC comprises a gate start pulse GSP, a gate shift clock GSC and a gate output enable GOE.

Especially, the timing controller 120 supplies the polarity control signal PCS along with digital data to the first and second data drivers 130 and 140, and controls such that analog data voltages outputted form the first and second data drivers 130 and 140 can have the opposite polarity from each other by using the polarity control signal PCS.

The first data driver 130 converts the digital data supplied from the timing controller 120 into an analog data voltage in response to the data driving control signal DDC from the timing controller 120, and supplies it to the m-number of first data lines DL1-1 to DL1-*m*. Especially, the polarity of the analog data voltage is inverted and supplied in 1 frame unit in response to the polarity control signal PCS from the timing controller 120.

Figure 3:
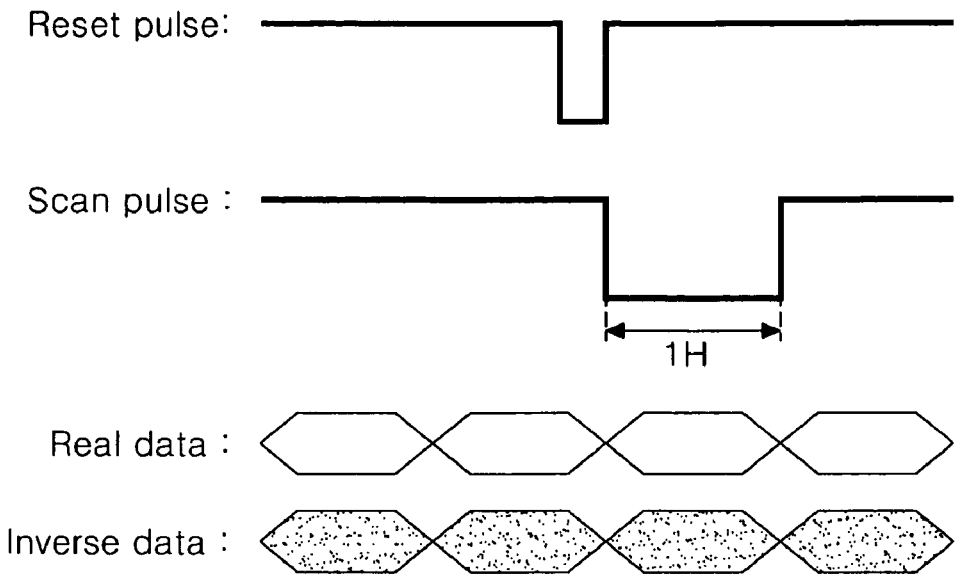
FIG. 3 is a signal characteristic diagram of an organic light emitting diode in accordance with one embodiment of the present invention.

As illustrated in FIG. 3, the first data driver 130 alternately supplies a real data voltage R_Vdata used for representing gray levels and an inverse data voltage S_Vdata not used for representing gray levels in 1 frame unit.

The second data driver 140 converts the digital data supplied from the timing controller 120 into an analog data voltage in response to the data driving control signal DDC from the timing controller 120, and supplies it to the m-number of second data lines DL2-1 to DL2-*m*. Especially, the polarity of the analog data voltage is inverted and supplied in 1 frame unit in response to the polarity control signal PCS from the timing controller 120.

As illustrated in FIG. 3, the second data driver 140 alternately supplies a real data voltage R_Vdata used for representing gray levels and an inverse data voltage S_Vdata not used for representing gray levels in 1 frame unit.

Also, the first and second data drivers 130 and 140 supply the analog data voltage having the opposite polarities, that is, the first data driver 130 supplies a real data voltage R_Vdata during one horizontal period 1H while the second data driver 140 supplies an inverse data voltage S_Vdata during one horizontal period 1H.

Likewise, during one horizontal period 1H, the first data driver 130 supplies an inverse data voltage S_Vdata while the second data driver 140 supplies a real data voltage R_Vdata.

The gate driver 150 sequentially supplies scan pulses to the n-number of gate lines GL1 to GLn in response to a gate driving control signal GDC from the timing controller 120.

As illustrated in FIG. 3, the gate driver 150 supplies a low level scan pulse to one gate line for one horizontal period, and supplies a high level signal to the gate line for the other periods.

The reset pulse supply unit 160 sequentially reset pulses to the n-number of reset lines RL1 to RLn in response to a reset control signal RSC from the timing controller 120. As illustrated in FIG. 3, the reset pulse supply unit 160 supplies a low level reset pulse during a predetermined period before a scan pulse is supplied to each gate line.

Figure 4:
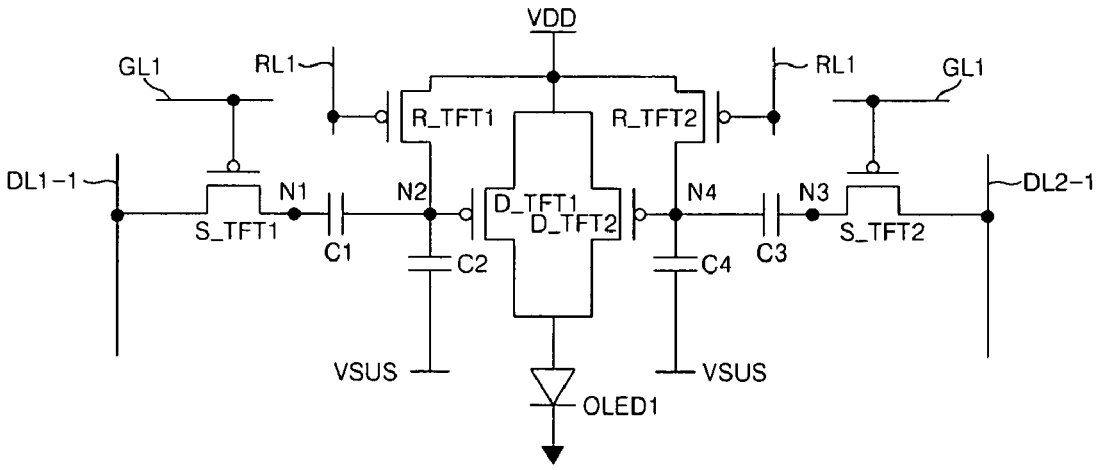
FIG. 4 is an equivalent circuit diagram of each pixel as illustrated in FIG. 2.

FIG. 4 is an equivalent circuit diagram of each pixel as illustrated in FIG. 2, which shows an equivalent circuit of a first pixel formed at crossing regions between the leading first and second data lines DL1-1 and DL2-1 and the leading gate line GL1. FIG. 4 shows the equivalent circuit of the first pixel for illustrative purposes for the convenience of description because each pixel has the same equivalent circuit.

Referring to FIG. 4, each pixel of the organic light emitting diode display 100 comprises an organic light emitting diode OLED1 applied with a high potential power voltage VDD to emit light, a switching thin film transistor S_TFT1 for switching the real data voltage R_Vdata and inverse data voltage S_Vdata on the first data line DL1-1, and a switching thin film transistor S_TFT2 for switching the real data voltage R_Vdata and inverse data voltage S_Vdata on the second data line DL1-2.

Furthermore, there are provided driving thin film transistors D_TFT1 and D_TFT2 alternately driven to supply a high potential power voltage VDD to the organic light emitting diode OLED1, a reset thin film transistor R_TFT1 for switching the high potential power voltage VDD and resetting the gate of the driving thin film transistor D_TFT1, and a reset thin film transistor R_TFT2 for switching the high potential power voltage VDD and resetting the gate of the driving thin film transistor D_TFT2.

Furthermore, each pixel of the organic light emitting diode display device 100 comprises a capacitor C1 for charging the real data voltage R_Vdata switched through the switching thin film transistor S_TFT1, a capacitor C2 for holding the voltage of the capacitor C1 so as to be stably supplied to the gate of the driving thin film transistor D_TFT1, a capacitor C3 for charging the real data voltage R_Vdata switched through the switching thin film transistor S_TFT2, and a capacitor 4 for holding the voltage of the capacitor C3 so as to be stably supplied to the gate of the driving thin film transistor D_TFT2.

Here, a node N1 is the drain of the switching thin film transistor S_TFT1 and the capacitor C1, and a node N2 is located between the capacitors C1 and C2 and the gate of the driving thin film transistor D_TFT1.

Also, a node N3 is the drain of the switching thin film transistor S_TFT2 and the capacitor C3, and a node N4 is located between the capacitors C3 and C4 and the gate of the driving thin film transistor D_TFT2.

The organic light emitting diode OLED1 has an anode commonly connected to the drains of the driving thin film transistors D_TFT1 and D_TFT2 connected in parallel and a cathode connected to the ground. The organic light emitting diode OLED1 of this type is driven by a high potential power voltage VDD supplied through the driving thin film transistor D_TFT1 or driving thin film transistor D_TFT2 alternately driven in 1 frame unit and a driving current proportional to the amplitude thereof.

The switching thin film transistor S_TFT1 has a gate connected to the gate line GL1, a source connected to the first data line DL1-1, and a drain connected to one side of the capacitor C1 through the node N1.

The switching thin film transistor S_TFT1 of this type is turned on by a low level scan pulse supplied through the gate line GL1 to switch the real data voltage R_Vdata or inverse data voltage S_Vdata on the first data line DL1-1 to the node N1.

The switching thin film transistor S_TFT2 has a gate connected to the gate line GL1, a source connected to the second data line DL2-1, and a drain connected to one side of the capacitor C3 through the node N3.

The switching thin film transistor S_TFT3 of this type is turned on by a low level scan pulse supplied through the gate line GL1 to switch the real data voltage R_Vdata or inverse data voltage S_Vdata on the second data line DL2-1 to the node N3.

The switching thin film transistors S_TFT1 and S_TFT2 are simultaneously turned on or off as they are commonly connected to one gate line GL1.

The driving thin film transistor D_TFT1 has a source connected to the power supply terminal to which a high potential power voltage VDD is applied, a drain connected to the anode of the organic light emitting diode OLED1, and a gate commonly connected to one sides of the capacitors C1 and C2 and the drain of the reset thin film transistor R_TFT1 through the node N2.

The driving thin film transistor D_TFT1 is reset by the high potential power voltage VDD supplied to its gate through the reset thin film transistor R_TFT1 during the supply of a reset pulse to the reset line RL1.

After the reset period, when an inverse data voltage S_Vdata is supplied to the node N1 through the switching thin film transistor S_TFT1 during the supply of a low level scan pulse to the gate line GL1, the driving thin film transistor D_TFT1 keeps a turned-off state because the voltage of the node N2 is higher than the high potential power voltage VDD by the inverse data voltage S_Vdata applied to the node 1.

On the contrary, after the reset period, when a real data voltage R_Vdata is supplied to the node N1 through the switching thin film transistor S_TFT1 during the supply of a low level scan pulse to the gate line GL1, a potential difference is generated between the real data voltage R_Vdata applied to the node N1 and the high potential power voltage VDD of the node N2 and thus the voltage of the node N2 is dropped in proportion to the level of the real data voltage R_Vdata. Hence, the driving thin film transistor D_TFT1 is turned on to supply the high potential power voltage VDD to the anode of the organic light emitting diode OLED1.

Here, the level of the voltage supplied to the anode of the organic light emitting diode OLED1 by the driving thin film transistor D_TFT1 increases and decreases in proportion to the level of the real data voltage R_Vdata supplied through the switching thin film transistor S_TFT1.

The driving thin film transistor D_TFT2 has a source connected to the power supply terminal to which a high potential power voltage VDD is applied, a drain connected to the anode of the organic light emitting diode OLED1, and a gate commonly connected to one sides of the capacitors C3 and C4 and the drain of the reset thin film transistor R_TFT2 through the node N4.

The driving thin film transistor D_TFT1 is reset by the high potential power voltage VDD supplied to its gate through the reset thin film transistor R_TFT2 during the supply of a reset pulse to the reset line RL1.

After the reset period, when an inverse data voltage S_Vdata is supplied to the node N1 through the switching thin film transistor S_TFT2 during the supply of a low level scan pulse to the gate line GL1, the driving thin film transistor D_TFT2 keeps a turned-off state because the voltage of the node N4 is higher than the high potential power voltage VDD by the inverse data voltage S_Vdata applied to the node 3.

On the contrary, after the reset period, when a real data voltage R_Vdata is supplied to the node N3 through the switching thin film transistor S_TFT2 during the supply of a low level scan pulse to the gate line GL1, a potential difference is generated between the real data voltage R_Vdata applied to the node N3 and the high potential power voltage VDD of the node N4 and thus the voltage of the node N4 is dropped in proportion to the level of the real data voltage R_Vdata. Hence, the driving thin film transistor D_TFT2 is turned on to supply the high potential power voltage VDD to the anode of the organic light emitting diode OLED1.

Here, the level of the voltage supplied to the anode of the organic light emitting diode OLED1 by the driving thin film transistor D_TFT2 increases and decreases in proportion to the level of the real data voltage R_Vdata supplied through the switching thin film transistor S_TFT2.

The driving thin film transistors D_TFT1 and D_TFT2 are connected in parallel and alternately driven in 1 frame unit.

The reset thin film transistor R_TFT1 has a gate connected to the reset line RL1, a source connected to the power supply terminal to which a high potential power voltage is applied, and a drain commonly connected to the capacitors C1 and C2 and the gate of the driving thin film transistors D_TFT1 through the node N2.

The reset thin film transistor R_TFT1 is driven by a low level reset pulse supplied through the reset line RL1 to supply the high potential power voltage VDD to the gate of the driving thin film transistor D_TFT1.

The reset thin film transistor R_TFT2 has a gate connected to the reset line RL1, a source connected to the power supply terminal to which a high potential power voltage is applied, and a drain commonly connected to the capacitors C3 and C4 and the gate of the driving thin film transistors D_TFT2 through the node N2.

The reset thin film transistor R_TFT2 is driven by a low level reset pulse supplied through the reset line RL1 to supply the high potential power voltage VDD to the gate of the driving thin film transistor D_TFT2.

The reset thin film transistors R_TFT1 and R_TFT2 are simultaneously turned on or off as they are commonly connected to one reset line GL1.

One side of the capacitor C1 is connected to the drain of the switching thin film transistor S_TFT1 through the node N1, and the other side of the capacitor C1 is commonly connected to the gate of the driving thin film transistor D_TFT1, the drain of the reset thin film transistor R_TFT1, and the capacitor C2 through the node N2.

The real data voltage R_Vdata supplied through the switching thin film transistor S_TFT1 is stored in the capacitor C1. Substantially, a voltage corresponding to a potential difference between the real data voltage R_Vdata applied to the node N1 and the high potential power voltage VDD applied to the node N2 is charged, and the thus-charged voltage of the capacitor C1 is maintained during 1 frame period.

One side of the capacitor C2 is connected to a reference power supply terminal applied with a reference voltage VSUS, and the other side of the capacitor C2 is commonly connected to the gate of the driving thin film transistor D_TFT1, the drain of the reset thin film transistor R_TFT1, and the capacitor C1 through the node N2.

The capacitor C2 of this type holds the voltage of the capacitor C1, thus stably supplying the voltage of the capacitor C1 to the gate of the driving thin film transistor D_TFT1.

One side of the capacitor C3 is connected to the drain of the switching thin film transistor S_TFT2 through the node N3, and the other side of the capacitor C3 is commonly connected to the gate of the driving thin film transistor D_TFT2, the drain of the reset thin film transistor R_TFT2, and the capacitor C4.

The real data voltage R_Vdata supplied through the switching thin film transistor S_TFT2 is stored in the capacitor C3. Substantially, a voltage corresponding to a potential difference between the real data voltage R_Vdata applied to the node N3 and the high potential power voltage VDD applied to the node N4 is charged, and the thus-charged voltage of the capacitor C3 is maintained during 1 frame period.

One side of the capacitor C4 is connected to a reference power supply terminal applied with a reference voltage VSUS, and the other side of the capacitor C4 is commonly connected to the gate of the driving thin film transistor D_TFT2, the drain of the reset thin film transistor R_TFT2, and the capacitor C4 through the node N4.

The capacitor C4 of this type holds the voltage of the capacitor C3, thus stably supplying the voltage of the capacitor C3 to the gate of the driving thin film transistor D_TFT2.

Although all the thin film transistors provided in each pixel are implemented as P-MOS thin film transistors, the present invention is not limited thereto. That is to say, the thin film transistors of each pixel may be implemented as N-MOS thin film transistors.

The operation of each pixel of the thus-constructed organic light emitting diode display device in accordance with one embodiment of the present invention will be described with reference to a flow chart. However, as each pixel is operated in the same manner, the operation of the first pixel as illustrated in FIG. 5 will be described for illustrative purposes for the convenience of description.

Figure 5:
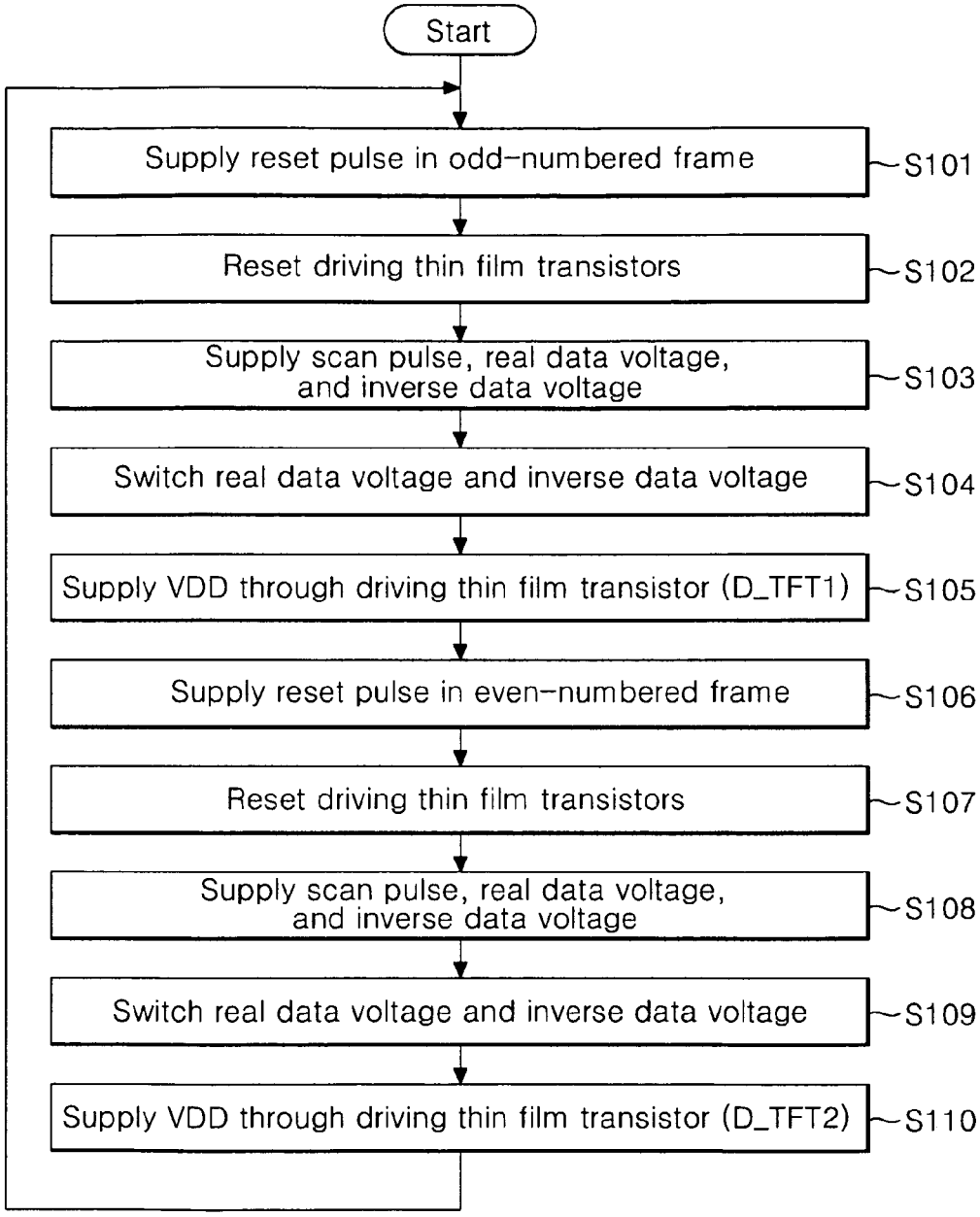
FIG. 5 is a flow chart of the operation of each pixel of an organic light emitting diode in accordance with one embodiment of the present invention.

FIG. 5 is a flow chart of the operation of each pixel of an organic light emitting diode in accordance with one embodiment of the present invention.

Referring to FIG. 5, in an odd-numbered frame, a low level reset pulse is supplied to the gates of the reset thin film transistors R_TFT1 and r_TFT2 through the reset line RL1 for a predetermined period.

Afterwards, the reset thin film transistor R_TFT1 is turned on to supply a high potential power voltage VDD to the gate of the driving thin film transistor D_TFT1 and reset the gate voltage of the driving thin film transistor D_TFT1, and at the same time, the reset thin film transistor R_TFT2 is turned on to supply a high potential power voltage VDD to the gate of the driving thin film transistor D_TFT2 and reset the gate voltage of the driving thin film transistor D_TFT2 (S102).

After the driving thin film transistors D_TFT1 and D_TFT2 are reset in an odd-numbered frame in this manner, a low level scan pulse is supplied to the gates of the switching thin film transistors S_TFT1 and S_TFT2 through the gate line GL1 for one horizontal period 1H, and at the same time, a real data voltage R_Vdata and an inverse data voltage S_Vdata are supplied to the first and second data lines DL1-1 and DL2-1, respectively (S103).

At this time, the real data voltage R_Vdata on the first data line DL1-1 is supplied to the node N1 through the switching thin film transistor S_TFT1, and at the same time, the inverse data voltage S_Vdata on the second data line DL2-1 is supplied to the node N3 through the switching thin film transistor S_TFT2 (S104).

By supplying the real data voltage R_Vdata to the node N1, and at the same time, supplying the inverse data voltage S_Vdata to the node N3, with the high potential power voltage VDD applied to the nodes N2 and N4, a potential difference is generated between the nodes N1 and N2, and thus the voltage of the node N2 is dropped in proportion to the level of the real data voltage R_Vdata. Hence, the driving thin film transistor D_TFT1 is turned on by the dropped voltage of the node N2 to supply the high potential power voltage VDD to the anode of the organic light emitting diode OLED1.

In contrast, the voltage of the node N4 becomes higher than the high potential power voltage VDD by the inverse data voltage S_Vdata applied to the node 3, and the driving thin film transistor D_TFT2 keeps a turned-off state by the higher voltage of the node N4 (S105).

After each pixel is driven in an odd-numbered frame in this manner, in an even-numbered frame, a low level reset pulse is supplied to the gate of the reset thin film transistors R_TFT1 and R_TFT2 through the reset line RL1 for a predetermined period (S106).

The reset thin film transistor R_TFT1 is turned on to supply a high potential power voltage VDD to the gate of the driving thin film transistor D_TFT1 and reset the gate voltage of the driving thin film transistor D_TFT1, and at the same time, the reset thin film transistor R_TFT2 is turned on to supply a high potential power voltage VDD to the gate of the driving thin film transistor D_TFT2 and reset the gate voltage of the driving thin film transistor D_TFT2 (S 107).

After the driving thin film transistors D_TFT1 and D_TFT2 are reset in an even-numbered frame in this manner, a low level scan pulse is supplied to the gates of the switching thin film transistors S_TFT1 and S_TFT2 through the gate line GL1 for one horizontal period 1H, and at the same time, a real data voltage R_Vdata and an inverse data voltage S_Vdata are supplied to the first and second data lines DL1-1 and DL2-1, respectively (S108).

At this time, the real data voltage R_Vdata on the first data line DL1-1 is supplied to the node N1 through the switching thin film transistor S_TFT1, and at the same time, the inverse data voltage S_Vdata on the second data line DL2-1 is supplied to the node N3 through the switching thin film transistor S_TFT2 (S108).

By supplying the real data voltage R_Vdata to the node N1, and at the same time, supplying the inverse data voltage S_Vdata to the node N3, with the high potential power voltage VDD applied to the nodes N2 and N4, the voltage of the node N4 becomes higher than the high potential power voltage VDD by the inverse data voltage S_Vdata applied to the node 3, and the driving thin film transistor D_TFT2 keeps a turned-off state by the higher voltage of the node N4.

In contrast, a potential difference is generated between the nodes N3 and N4, and thus the voltage of the node N4 is dropped in proportion to the level of the real data voltage R_Vdata. Hence, the driving thin film transistor D_TFT2 is turned on by the dropped voltage of the node N4 to supply the high potential power voltage VDD to the anode of the organic light emitting diode OLED1 (S110).

As discussed above, the organic light emitting diode display device in accordance with one embodiment of the present invention can compensate for a high potential power voltage, the driving voltage of the organic light emitting diode, dropped due to the resistance component of the power supply line and thus represent a desired gray level for each pixel by resetting the gates of the two driving thin film transistors provided in each pixel before the two driving thin film transistors are turned on.

Figure 6:
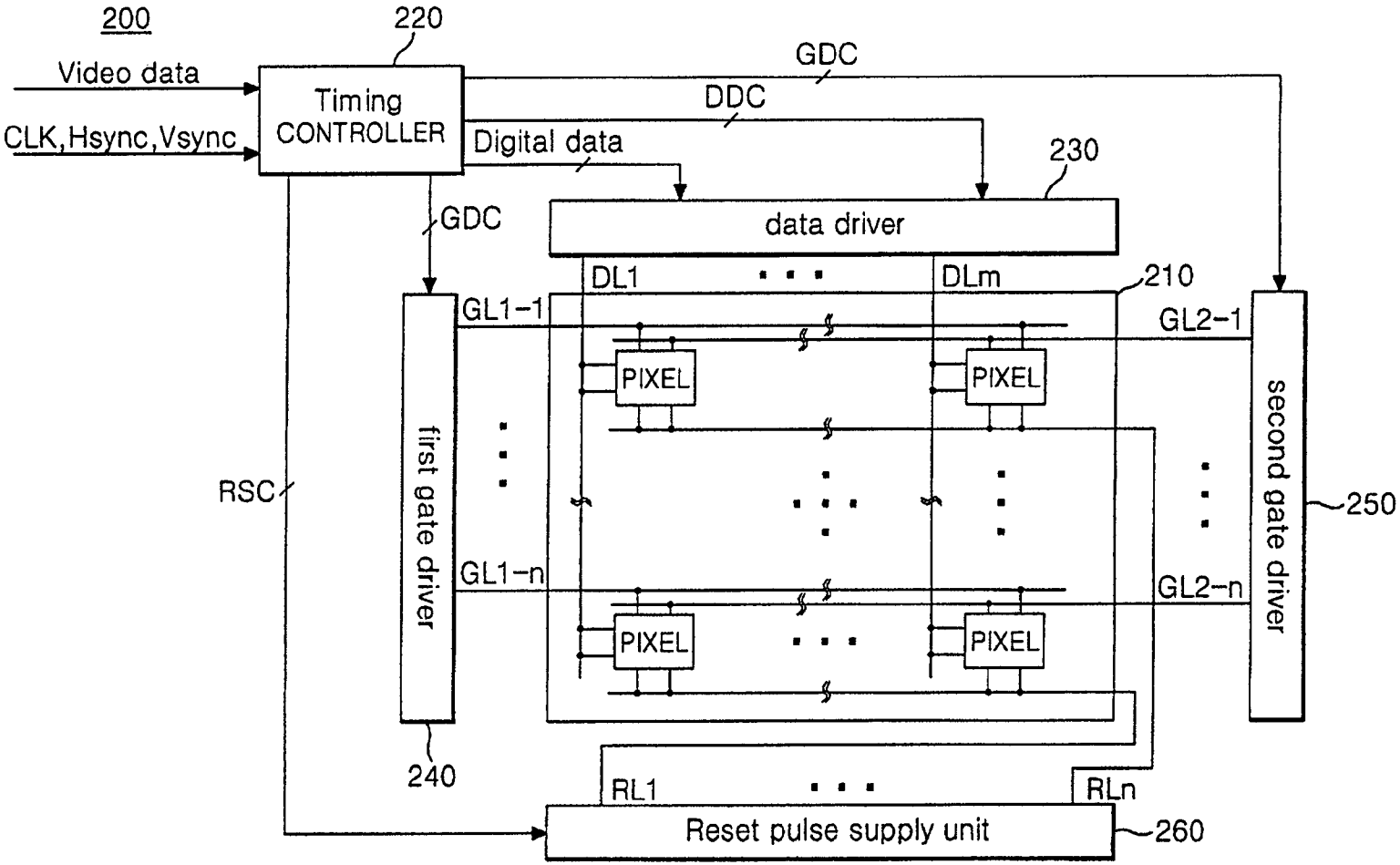
FIG. 6 is a block diagram of an organic light emitting diode display device in accordance with another embodiment of the present invention.

FIG. 6 is a block diagram of an organic light emitting diode display device in accordance with another embodiment of the present invention.

Referring to FIG. 6, the organic light emitting diode display device 200 in accordance with another embodiment of the present invention comprises a display panel 210 having an m-number of data lines DL1 to DLm and an n-number of first gate lines GL1-1 to GL1-*n* crossing each other, the m-number of data lines DL1 to DLm and an n-number of second gate lines GL2-1 to GL2-*n* crossing each other, pixels formed at common crossing regions, and an n-number of reset lines RL1 to RLn arranged corresponding to the n-number of first and second gate lines GL1-1 to GL1-*n* and GL2-1 to GL2-*n* one by one and connected to the adjacent pixels, and a timing controller 220 for controlling data display on the display panel 210.

Additionally, the organic light emitting diode display device 200 comprises a data driving 30 for converting digital data supplied from the timing controller 220 into a real data voltage R_Vdata and an inverse data voltage S_Vdata under control of the timing controller 220 to sequentially supply the same to the m-number of data lines DL1 to DLm, a first gate drover 240 for sequentially supplying a first scan pulse to the n-number of first gate lines GL1-1 to GL1-*n* under control of the timing controller 220, a second gate driver 250 for sequentially supplying a second scan pulse to the n-number of second gate lines GL2-1 to GL2-*n* under control of the timing controller 220, and a reset pulse supply unit 260 for sequentially supplying reset pulses to the n-number of reset lines RL1 to RLn under control of the timing controller 220.

On the display panel 210, the m-number of data lines DL1 to DLm, the n-number of first gate lines GL1-1 to GL1-*n*, the m-number of second gate lines GL2-1 to DGL2-*m*, and the n-number or reset lines RL1 to RLn are arranged.

Herein, the m-number of first gate lines GL1-1 to GL1-*n* and the n-number of second gate lines GL2-1 to GL2-*n* cross the m-number of data lines DL1 to DLm to form common crossing regions, and pixels each having two driving thin film transistors are formed in the crossing regions. The n-number or reset lines RL1 to RLn are arranged corresponding to the n-number of first and second gate lines GL1-1 to GL1-*n* and GL2-1 to GL2-*n* one by one and connected to the adjacent pixels.

The timing controller 220 supplies digital video data (RGB data or RGBW data or the like) inputted from the system to the data driver 230. Also, the timing controller 220 generates a data driving control signal DDC and a gate driving control signal GDC using a horizontal/vertical synchronizing signal H and V, and a reset control signal RSC.

The timing controller 220 supplies the generated driving control signal DDC to the first and second gate drivers 240 and 250. Also, the timing controller 220 supplies the generated gate driving control signal GDC and reset control signal RSC to the data driver 230 and the reset pulse supply unit 260, respectively.

Herein, the data driving control signal DDC comprises a source start pulse SSP and a source shift clock signal SSC, and the gate driving control signal GDC comprises a gate start pulse GSP, a gate shift clock GSC and a gate output enable GOE.

The data driver 230 converts the digital data supplied from the timing controller 220 into an analog real data voltage R_Vdata and an inverse data voltage S_Vdata in response to the data driving control signal DDC from the timing controller 220, and sequentially supplies them to the m-number of data lines DL1 to DLm.

Figure 7:
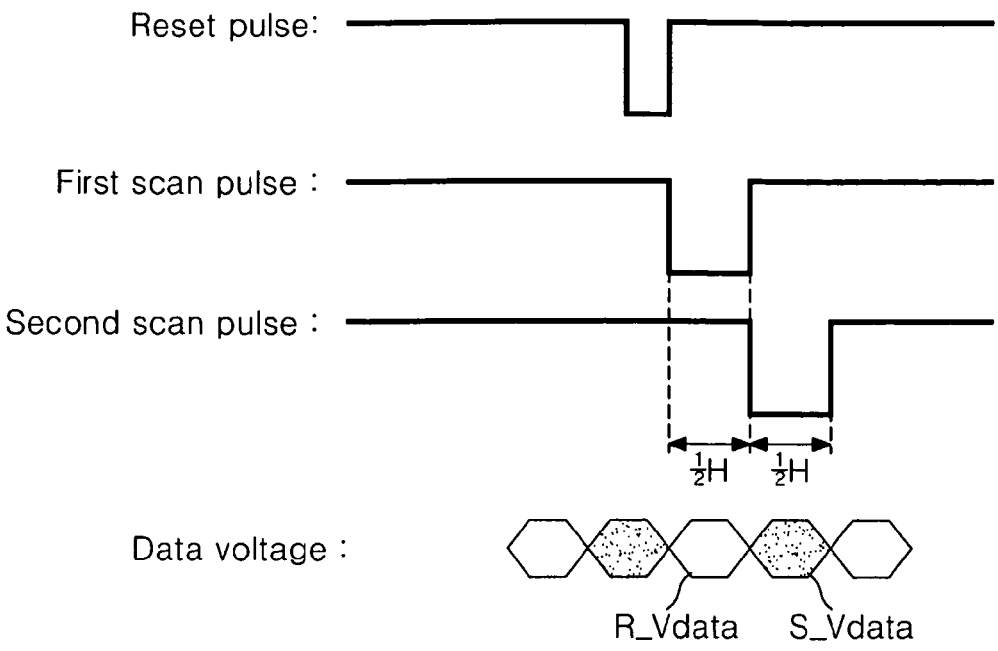
FIG. 7 is a signal characteristic diagram of an organic light emitting diode in accordance with another embodiment of the present invention.

As illustrated in FIG. 7, the data driver 230 sequentially supplies a real data voltage R_Vdata and an inverse data voltage S_Vdata in one horizontal line. The real data voltage R_Vdata is supplied for a first half H/2 of one horizontal period 1H, and then the inverse data voltage S_Vdata is supplied for the latter half H/2 of the horizontal period 1H.

The data driver 230 changes the supply sequence of the real data voltage R_Vdata and the inverse data voltage S_Vdata sequentially supplied for one horizontal period in one frame unit.

Namely, in one of the neighboring frames, the data driver 230 sequentially supplies a real data voltage R_Vdata and an inverse data voltage S_Vdata to 1 horizontal line for one horizontal period, and then in another one of the neighboring frames, the data driver 230 sequentially supplies a real data voltage R_Vdata and an inverse data voltage S_Vdata to 1 horizontal line for one horizontal period.

The first gate driver 240 sequentially supplies a first scan pulse to the n-number of first gate lines GL1-1 to GL1-*n* in response to a gate driving control signal GDC from the timing controller 220. Especially, as illustrated in FIG. 7, the first gate driver 240 supplies a low level first scan pulse to one first gate line for a ½ horizontal period H/2, and supplies a high level signal thereto for the other periods.

The first gate driver 240 supplies a first scan pulse to the first gate line at the front end of the two neighboring first gate lines for a ½ horizontal period, and then, after the elapse of the ½ horizontal period, supplies a first scan pulse to the first gate line at the rear end thereof for a ½ horizontal period.

The second gate driver 250 sequentially supplies a second scan pulse to the n-number of second gate lines GL2-1 to GL2-*n* in response to a gate driving control signal GDC from the timing controller 220. Especially, as illustrated in FIG. 7, the second gate driver 250 supplies a low level second scan pulse to one second gate line for a ½ horizontal period H/2, and supplies a high level signal thereto for the other periods.

The second gate driver 250 supplies a second scan pulse to the second gate line at the front end of the two neighboring second gate lines for a ½ horizontal period, and then, after the elapse of the ½ horizontal period, supplies a second scan pulse to the second gate line at the rear end thereof for a ½ horizontal period.

As illustrated in FIG. 7, first and second scan pulses are sequentially supplied to each pixel, to which the first and second gate lines are commonly connected, for one horizontal period 1H.

The reset pulse supply unit 260 sequentially reset pulses to the n-number of reset lines RL1 to RLn in response to a reset control signal RSC from the timing controller 220.

As illustrated in FIG. 7, the reset pulse supply unit 260 supplies a low level reset pulse during a predetermined period before a first scan pulse is supplied to each first gate line.

Figure 8:
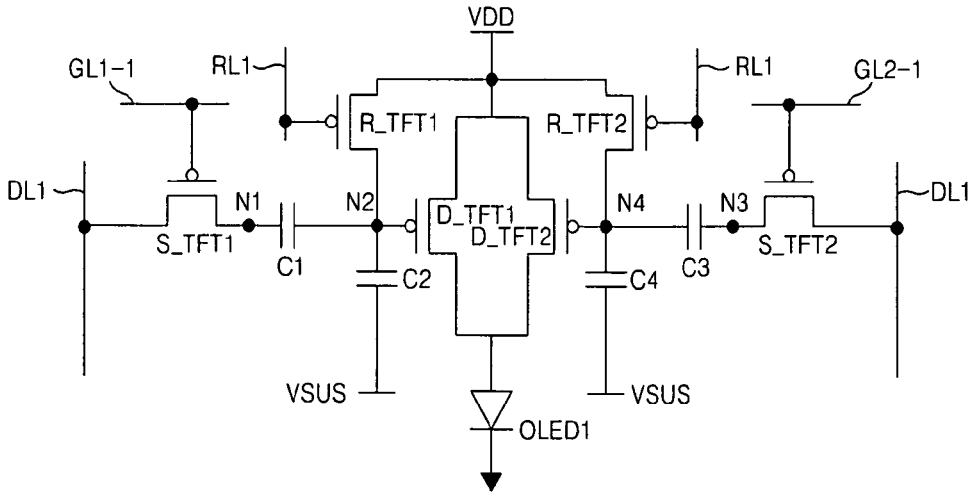
FIG. 8 is an equivalent circuit diagram of each pixel as illustrated in FIG. 7.

FIG. 8 is an equivalent circuit diagram of each pixel as illustrated in FIG. 6, which shows an equivalent circuit of a first pixel formed at crossing regions between the leading first and second gate lines GL1-1 and GL2-1 and the leading data line DL1. FIG. 8 shows the equivalent circuit of the first pixel for illustrative purposes for the convenience of description because each pixel has the same equivalent circuit.

Referring to FIG. 8, like each pixel of the organic light emitting diode display device 100 as illustrated in FIG. 4, each pixel of the organic light emitting diode display 200 comprises an organic light emitting diode OLED1, switching thin film transistors S_TFT1 and S_TFT2, driving thin film transistors D_TFT1 and D_TFT2, reset thin film transistors R_TFT1 and R_TFT2, and capacitors C1 to C4.

Further, in the same way as in FIG. 4, in each pixel of the organic light emitting diode display device 200, a node N1 is located between the drain of the switching thin film transistor S_TFT1 and the capacitor C1, and a node N2 is located between the capacitors C1 and C2 and the gate of the driving thin film transistor D_TFT1.

Also, in each pixel of the organic light emitting diode display device 200, a node N3 is the drain of the switching thin film transistor S_TFT2 and the capacitor C3, and a node N4 is located between the capacitors C3 and C4 and the gate of the driving thin film transistor D_TFT2.

In each pixel of the organic light emitting diode display device 100 as illustrated in FIG. 4, one gate line GL1 is commonly connected to the gates of the switching thin film transistors S_TFT1 and S_TFT2, and the first and second data lines DL1-1 and DL2-1 are connected to the sources of the driving thin film transistors D_TFT1 and D_TFT2, respectively.

On the contrary, In each pixel of the organic light emitting diode display device 200 as illustrated in FIG. 8, one data line DL1 is commonly connected to the gates of the driving thin film transistors D_TFT1 and D_TFT2, and the first and second gate lines GL1-1 and GL2-1 are connected to the sources of the switching thin film transistors S_TFT1 and S_TFT2, respectively.

Although all the thin film transistors provided in each pixel of the organic light emitting diode display device 200 are implemented as P-MOS thin film transistors, the present invention is not limited thereto. That is to say, the thin film transistors of each pixel may be implemented as N-MOS thin film transistors.

The operation of each pixel of the thus-constructed organic light emitting diode display device in accordance with another embodiment of the present invention will be described with reference to a flow chart. However, as each pixel is operated in the same manner, the operation of the first pixel as illustrated in FIG. 8 will be described for illustrative purposes for the convenience of description.

FIG. 8 is a flow chart of the operation of each pixel of an organic light emitting diode in accordance with another embodiment of the present invention.

Referring to FIG. 8, a low level reset pulse is supplied to the gates of the reset thin film transistors R_TFT1 and r_TFT2 through the reset line RL1 for a predetermined period.

Afterwards, the reset thin film transistor R_TFT1 is turned on to supply a high potential power voltage VDD to the gate of the driving thin film transistor D_TFT1 and reset the gate voltage of the driving thin film transistor D_TFT1.

At the same time, the reset thin film transistor R_TFT2 is turned on to supply a high potential power voltage VDD to the gate of the driving thin film transistor D_TFT2 and reset the gate voltage of the driving thin film transistor D_TFT2 (S202).

After the driving thin film transistors D_TFT1 and D_TFT2 are reset, a low level first scan pulse is supplied to the gate of the switching thin film transistor S_TFT1 through the first gate line GL1-1 for a ½ horizontal period, and at the same time, a real data voltage R_Vdata is supplied to the data line DL1, respectively (S203).

At this time, the real data voltage R_Vdata on the data line DL1 is supplied to the node N1 through the switching thin film transistor S_TFT1 (S204).

By supplying the real data voltage R_Vdata to the node N1, with the high potential power voltage VDD applied to the node N2, a potential difference is generated between the nodes N1 and N2, and thus the voltage of the node N2 is dropped in proportion to the level of the real data voltage R_Vdata. Hence, the driving thin film transistor D_TFT1 is turned on by the dropped voltage of the node N2 to supply the high potential power voltage VDD to the anode of the organic light emitting diode OLED 1 (S205).

Next, as illustrated in FIG. 7, a second scan pulse is supplied to the gate of the switching thin film transistor S_TFT2 through the second gate line GL2-1 for a ½ horizontal period, and, at the same time, an inverse data voltage S_Vdata is supplied to the data lines DL (S206).

At this time, the inverse data voltage S_Vdata on the data line DL1 is supplied to the node N3 through the switching thin film transistor S_TFT2 (S207).

By supplying the inverse data voltage S_Vdata to the node N3, with the high potential power voltage VDD applied to the node N4, the voltage of the node N4 becomes higher than the high potential power voltage VDD by the inverse data voltage S_Vdata applied to the node 3, and the driving thin film transistor D_TFT2 keeps a turned-off state by the higher voltage of the node N4 (S208).

Figure 9:
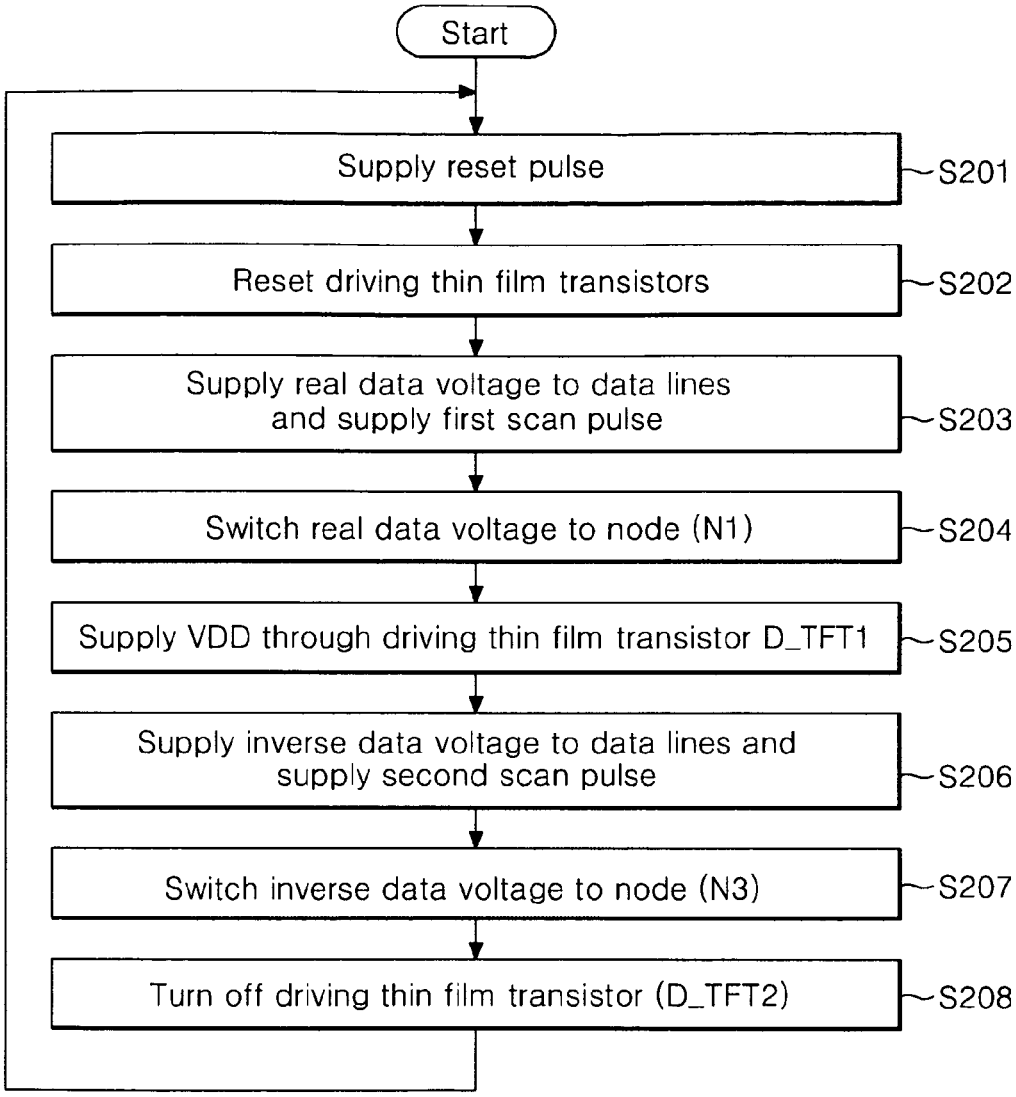
FIG. 9 is a flow chart of the operation of each pixel of an organic light emitting diode in accordance with another embodiment of the present invention.

Referring to FIG. 9, the driving sequence of the driving thin film transistors D_TFT1 and D_TFT2 of each pixel as explained above is changed in 1 frame unit, and the supply sequence of the real data voltage R_Vdata and the inverse data voltage S_Vdata sequentially supplied to each pixel for one horizontal period is also changed in 1 frame unit.

As described above, the organic light emitting diode display device in accordance with another embodiment of the present invention can compensate for a high potential power voltage, the driving voltage of an organic light emitting diode, dropped by the resistance component on a power supply line and thus, represent a desired gray level for each pixel by resetting the gates of the two driving thin film transistors D_TFT1 and D_TFT2 provided in each pixel before the two driving thin film transistors are turned on.

The present invention can compensate for a high potential power voltage, the driving voltage of an organic light emitting diode, dropped by the resistance component on a power supply line and thus, represent a desired gray level for each pixel by resetting the gates of the two driving thin film transistors provided in each pixel before the two driving thin film transistors are turned on.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. An organic light emitting diode display device, comprising:

a display panel having an m-number of first data lines and an n-number of gate lines crossing each other, an m-number of second data lines and the n-number of gate lines crossing each other, pixels formed at common crossing regions, and an n-number of reset lines arranged corresponding to the n-number of gate lines one by one and connected to the adjacent pixels;

a data driving circuit configured to convert input digital data into a real data voltage and an inverse data voltage and selectively supplying the real data voltage and the inverted data voltage to the first and second data lines;

a gate driver configured to sequentially supply scan pulse to the gate lines; and a reset pulse supply unit configured to sequentially supply reset pulse to the reset lines, wherein each pixel comprises:

a single organic light emitting diode applied with a high potential power voltage to emit light;

a first switching thin film transistor turned on by the scan pulse supplied through the gate lines to switch the real data voltage and inverse data voltage on the first data lines;

a second switching thin film transistor turned on by the scan pulse supplied through the gate lines to switch the real data voltage and inverse data voltage on the second data lines;

a first driving thin film transistor turned on, when the real data voltage is switched through the first switching thin film transistor, to supply the high potential power voltage to the single organic light emitting diode;

a second driving thin film transistor turned on, when the real data voltage is switched through the second switching thin film transistor, to supply the high potential power voltage to the single organic light emitting diode;

a first reset thin film transistor turned on by the reset pulse to switch the high potential power voltage and reset the gate of the first driving thin film transistor, wherein the first reset thin film transistor has a gate to which the reset pulse is supplied, a source to which the high potential power voltage is supplied, and a drain directly connected to a gate of the first driving thin film transistor;

a second reset thin film transistor turned on by the reset pulse to switch the high potential power voltage and reset the gate of the second driving thin film transistor, wherein the second reset thin film transistor has a gate to which the reset pulse is supplied, a source to which the high potential power voltage is supplied, and a drain directly connected to a gate of the second driving thin film transistor;

a first capacitor configured to charge the real data voltage switched through the first switching thin film transistor;

a second capacitor configured to hold the voltage of the first capacitor, wherein the second capacitor has one electrode to which a reference voltage is supplied and another electrode which is commonly connected to the gate of the first driving thin film transistor, the drain of the first reset thin film transistor and the first capacitor;

a third capacitor configured to charge the real data voltage switched through the second switching thin film transistor; and a fourth capacitor configured to hold the voltage of the third capacitor, wherein the fourth capacitor has one electrode to which the reference voltage is supplied and another electrode which is commonly connected to the gate of the second driving thin film transistor, the drain of the second reset thin film transistor and the third capacitor, wherein the first and second reset thin film transistors are simultaneously turned on by the reset pulse to simultaneously reset the first and second driving thin film transistors.

2. The organic light emitting diode display device of claim 1, wherein the data driving circuit comprises:

a first data driver for converting the input digital data into the real data voltage or the inverse data voltage to supply the same to first data lines; and a second data driver for converting the input digital data into the real data voltage or the inverse data voltage to supply the same to the second data lines.

3. The organic light emitting diode display device of claim 2, wherein the first data driver alternately supplies the real data voltage and the inverse data voltage to the first data lines in 1 frame unit.

4. The organic light emitting diode display device of claim 2, wherein the second data driver alternately supplies the real data voltage and the inverse data voltage to the second data lines in 1 frame unit.

5. The organic light emitting diode display device of claim 1, wherein the first and second switching thin film transistors are simultaneously turned on by the scan pulse after the first and second driving thin film transistors are reset.

6. The organic light emitting diode display device of claim 5, wherein the first switching thin film transistor switches the real data voltage on the first data line, while the second switching thin film transistor switches the inverse data voltage on the second data line.

7. The organic light emitting diode display device of claim 6, wherein the first driving thin film transistor is turned on by the real data voltage to supply the high potential power voltage to the single organic light emitting diode, while the second deriving thin film transistor is turned off by the inverse data voltage.

8. The organic light emitting diode display device of claim 5, wherein the first switching thin film transistor switches the inverse data voltage on the first data line, while the second switching thin film transistor switches the real data voltage on the second data line.

9. The organic light emitting diode display device of claim 8, wherein the first driving thin film transistor is turned off by the inverse data voltage, while the second driving thin film transistor is turned on by the real data voltage to supply the high potential power voltage to the single organic light emitting diode.

10. The organic light emitting diode display device of claim 1, wherein the reset pulse is supplied for a predetermined time before the supply of the scan pulse, and the scan pulse is supplied for one horizontal period after the supply of the reset pulse.

11. The organic light emitting diode display device of claim 1, wherein the real data voltage and the inverse data voltage are alternately supplied to the first and second driving thin film transistors in 1 frame unit.

12. An organic light emitting diode display device, comprising:

a display panel having an m-number of data lines and an n-number of first gate lines crossing each other, the m-number of data lines and an n-number of second gate lines crossing each other, pixels formed at common crossing regions, and an n-number of reset lines arranged corresponding to the n-number of first and second gate lines one by one and connected to the adjacent pixels;

a data driver configured to convert digital data inputted in 1 horizontal unit into a real data voltage and an inverse data voltage and selectively supplying the real data voltage and the inverse data voltage to the first and second data lines for 1 horizontal period;

a gate driving circuit configured to sequentially supply a first scan pulse to the first gate lines and a second scan pulse to the second gate lines; and a reset pulse supply unit configured to sequentially supply reset pulse to the reset lines, wherein the gate driver sequentially supplies the first and second scan pulses to the first and second gate lines included in the same horizontal line, wherein each pixel comprises:

a single organic light emitting diode applied with a high potential power voltage to emit light;

a first switching thin film transistor turned on by the first scan pulse supplied through the first gate lines to switch the real data voltage and inverse data voltage on the data lines;

a second switching thin film transistor turned on by the second scan pulse supplied through the second gate lines to switch the real data voltage and inverse data voltage on the data lines;

a first driving thin film transistor turned on, when the real data voltage is switched through the first switching thin film transistor, to supply the high potential power voltage to the single organic light emitting diode;

a second driving thin film transistor turned on, when the real data voltage is switched through the second switching thin film transistor, to supply the high potential power voltage to the single organic light emitting diode;

a first reset thin film transistor turned on by the reset pulse to switch the high potential power voltage and reset the gate of the first driving thin film transistor, wherein the first reset thin film transistor has a gate to which the reset pulse is supplied, a source to which the high potential power voltage is supplied, and a drain directly connected to a gate of the first driving thin film transistor;

a second reset thin film transistor turned on by the reset pulse to switch the high potential power voltage and reset the gate of the second driving thin film transistor, wherein the second reset thin film transistor has a gate to which the reset pulse is supplied, a source to which the high potential power voltage is supplied, and a drain directly connected to a gate of the second driving thin film transistor;

a first capacitor configured to charge the real data voltage switched through the first switching thin film transistor;

a second capacitor configured to hold the voltage of the first capacitor, wherein the second capacitor has one electrode to which a reference voltage is supplied and another electrode which is commonly connected to the gate of the first driving thin film transistor, the drain of the first reset thin film transistor and the first capacitor;

a third capacitor configured to charge the real data voltage switched through the second switching thin film transistor; and a fourth capacitor configured to hold the voltage of the third capacitor, wherein the fourth capacitor has one electrode to which the reference voltage is supplied and another electrode which is commonly connected to the gate of the second driving thin film transistor, the drain of the second reset thin film transistor and the third capacitor, wherein the first and second reset thin film transistors are simultaneously turned on by the reset pulse to simultaneously reset the first and second driving thin film transistors.

13. The organic light emitting diode display device of claim 12, wherein the gate driving circuit comprises:

a first gate driver for sequentially supplying the first scan pulse to the first gate lines; and a second gate driver for sequentially supplying the second scan pulse to the second gate lines.

14. The organic light emitting diode display device of claim 12, wherein the first gate driver supplies the first scan pulse to one of the first gate lines for ½ horizontal period, and the second gate driver supplies the second scan pulse to one of the second gate lines for ½ horizontal period.

15. The organic light emitting diode display device of claim 12, wherein after the first and second driving thin film transistors are reset, the first switching thin film transistor is turned on by the first scan pulse and then the second switching thin film transistor is turned on by the second scan pulse.

16. The organic light emitting diode display device of claim 15, wherein the data driver changes the supply sequence of the real data voltage and inverse data voltage sequentially supplied for one horizontal period in one frame unit, and the real data voltage and the inverse data voltage are supplied for ½ horizontal period, respectively.

17. The organic light emitting diode display device of claim 12, wherein the reset pulse is supplied for a predetermined time before the supply of the first scan pulse.

18. The organic light emitting diode display device of claim 12, wherein the first and second scan pulses are supplied for ½ horizontal period, respectively.

19. The organic light emitting diode display device of claim 12, wherein the supply sequence of the real data voltage and inverse data voltage sequentially supplied for one horizontal period is changed in one frame unit, and the real data voltage and the inverse data voltage are supplied for ½ horizontal period, respectively.

* * * * *